US005992618A

United States Patent [19]

Joh

[11] Patent Number: 5,992,618

[45] Date of Patent: Nov. 30, 1999

[54] POCKET CARRIER OF INDEX CARDS

[76] Inventor: Duksung Joh, 3604 Sadlers Walk, Marietta, Ga. 30068

[21] Appl. No.: 09/248,862

[22] Filed: Feb. 11, 1999

[51] Int. Cl.[6] ..... A45C 11/18

[52] U.S. Cl. ..... 206/39; 206/38; 206/425

[58] Field of Search ..... 206/37, 38, 39, 206/39.1, 39.3, 39.5, 39.6, 39.7, 425; 150/147

[56] References Cited

U.S. PATENT DOCUMENTS

| | | | |
|---|---|---|---|
| 3,688,896 | 9/1972 | Newell | 206/39.6 |
| 4,449,628 | 5/1984 | Egly et al. | 206/425 |
| 4,505,404 | 3/1985 | Perchak et al. . | |
| 4,527,690 | 7/1985 | Schmidts et al. . | |
| 4,949,484 | 8/1990 | Finger . | |
| 5,125,505 | 6/1992 | Kurosaki . | |
| 5,452,793 | 9/1995 | DiMeo, Jr. et al. . | |
| 5,642,807 | 7/1997 | Barnes | 206/38 |
| 5,823,353 | 10/1998 | Perrin et al. . | |

*Primary Examiner*—Paul T. Sewell
*Assistant Examiner*—Luan K. Bui
*Attorney, Agent, or Firm*—Testa, Hurwitz & Thibeault, LLP

[57] ABSTRACT

A pocket carrier of index cards comprises a main body, a hood that is hinge-mounted on the main body, a latch set equipped on the rear-side of the main body for locking of the hood, and a rear cover plate to protect the latch set. The main body has a front-side wall, a rear-side wall, and two lateral-side walls. The front-side wall of the main body have the concave sections at the left top corner portion and the right top corner portion to enable the thumb to approach the index cards contained therein. The rear-side wall and the lateral-side walls of the main body have the top inner portions tapered outwardly to facilitate inserting of the reviewed card back to the main body. The hood includes a front-side wall having a plate spring, a top-side wall, and two lateral-side walls, each with a hook, a hinge hole, and a concave section. The latch set consists of opening tabs, anchoring blades, generally semi-circular springs, and a connector rod. The hood is locked on the main body by the hooks and the anchoring blades when the carrier is closed. The carrier is opened by the plate spring on the hood when the anchoring blades are displaced from the squared groove of the hooks by pulling in the opening tabs toward each other.

11 Claims, 7 Drawing Sheets

POCKET CARRIER OF INDEX CARDS

FIELD OF THE INVENTION

The present invention relates generally to index card carriers, more specifically, to pocket carrier of index cards.

BACKGROUND OF THE INVENTION

Generally, the conventional boxes or cases of business cards or game cards have been designed and manufactured for the similar purpose, such that the cards are protected from being damaged or dog-eared when being carried in one's pocket. In these designs, the cases have a main body for holding the cards and a lid to cover the cards. When the index cards, such as the educational flash cards, are stored in a case, however, the conventional designs have a few serious shortcomings.

The major purpose of carrying the educational flash cards is to review repeatedly the contents written on the cards. A card is retrieved from the carrying case and returned into the case after being reviewed, and then the next card is retrieved and reviewed, in such a manner that all the flash cards in the case can be repeatedly reviewed in rotation. The conventional designs, however, have been inconvenient and inappropriate for this usage since, in those designs, all the cards had to be taken out of the case when only one card is to be grasped and reviewed at a time.

If the cards are held in a hand, the cards can easily get wet and disfigured by the perspiration from the palm. Some of the attempts to overcome this difficulty, which arises when only one card is sought to be grasped, can be found in the arts, as shown in U.S. Pat. No. 5,823,353 (Perrin et al.) and U.S. Pat. No. 5,452,793 (DiMeo, Jr., et al.). However, in all the prior-art designs of business card cases, the function of returning each reviewed flash card back to the carrier was not addressed at all, because it was not necessary to the business card cases.

Another important major feature that has been overlooked in the prior-art designs is an active locking device of the case. In the conventional designs the lid is kept with the main body by a passive means such as a tab or a groove which cannot securely lock the two pieces together. When the physically active teenagers use such a case for the educational flash cards, the case may be opened unintentionally or the tabs may be worn out by the repeated opening and closing of the carrier.

SUMMARY OF THE INVENTION

The present invention comprises a novel design of an index card carrier by which the aforementioned problems of prior-art carriers are satisfactorily solved. To be more specific, the present invention combines a plurality of unique features, including the main body of the carrier with an opening at the top whereto the index cards are inserted, having the top inner portions of the rear-side wall and lateral-side walls tapered outwardly; said tapered sections at the top inner portion of the rear-side wall comprising one higher section in the middle and two lower sections on the left and right sides thereof; said tapered sections at the top inner portion of the lateral-side walls being rounded toward the front-side wall of said main body; said front-side wall, wherefrom the left and right corner portions at the top are removed, having generally the same height as the cards contained therein; said main body having two short hinge pins protruded at the bottom portions of said lateral-side walls; a hood, hinged at the holes on the two lateral sides by said hinge pins on the main body, covering the top opening and the two removed sections of said front-side wall of said main body; said hood having two hooks at the two lateral sides; each of said hooks having a tapered section at the tip and a groove subsequently thereto; said hood having a plate spring pushing said front-side wall of the main body when the hood is closed; the latch set securely fastened to the exterior face of rear-side wall of said main body by a plurality of anchoring pins; said latch set having a plurality of anchoring blades to hold said hooks of the hood when the hood is closed; said anchoring blades of the latch set having tapered edges to be in compliance with the tapered tips of said hooks when the hood is closed; said latch set having a plurality of generally semicircular spring sections to facilitate bending thereof; said latch set having end tabs to be pulled in for the purpose of releasing said hooks of the hood; a rear cover plate to cover and protect said latch set; said rear cover plate having two concave sections at the top two corners and a plurality of screw holes.

In a preferred embodiment, it is extremely easy to open the aforementioned pocket carrier of index cards; first the carrier is held in one hand with the thumb and the middle finger on the opening tabs of the latch set, and then, by pulling the tabs toward each other, the hood of the carrier is unhooked from the anchoring blades of the latch set. Then, the hood opens immediately, pushed by the force from the plate spring of the hood. All this opening sequence is completed in a single step and in a fraction of a second by using only one hand. The users are then ready to grasp the first index card shown at the front side of the main body of the carrier by using the thumb and the index finger of the other hand. The front card is approached through one of the removed top-corner sections of the front-side wall and through the top opening. After the front index card is reviewed, the card is inserted back to the carrier between the rearmost card and the inner face of the rear-side wall of the main body, guided by the tapered sections at the top of the rear-side wall and the lateral-side walls. Closing of the hood is also very simple. When the hood and the main body are simply put together, the tapered section at the tip of each hook pushes in the anchoring blade of the latch set. As the tapered section at the tip of each hook is switched by the squared groove thereof when the hook is pushed in further against the main body, the anchoring blade snaps back into the locking position. All this closing sequence is also achieved in a single step motion and in a fraction of a second by using only one hand.

It is a principal object of the present invention to provide a novel and small pocket carrier of index cards, which enables the user to carry the index cards in a pocket in the most protective and convenient manner.

It is an additional object of the present invention to provide an improved pocket carrier of index cards comprising the main body and the hood which can be opened or closed in a single step motion by using only one hand, leaving the other hand free to work with the index cards contained therein.

Yet another object is to provide an improved pocket carrier of index cards comprising a plurality of concave sections at said front-side wall of the main body which enables the user to grasp the front one of the index cards contained therein by using the thumb and a finger.

It is a further object of the present invention to provide an improved pocket carrier of index cards comprising a plurality of tapered sections at the top inner portions of the main body to allow the users to insert the reviewed index cards back in the carrier in the most convenient and carefree way.

BRIEF DESCRIPTION OF THE DRAWINGS

The aforementioned objects and advantages of the present invention will be more fully understood hereinafter as a result of the following detailed description of the invention when taken in conjunction with the following drawings.

DETAILED DESCRIPTION OF THE INVENTION

Figure 1A:
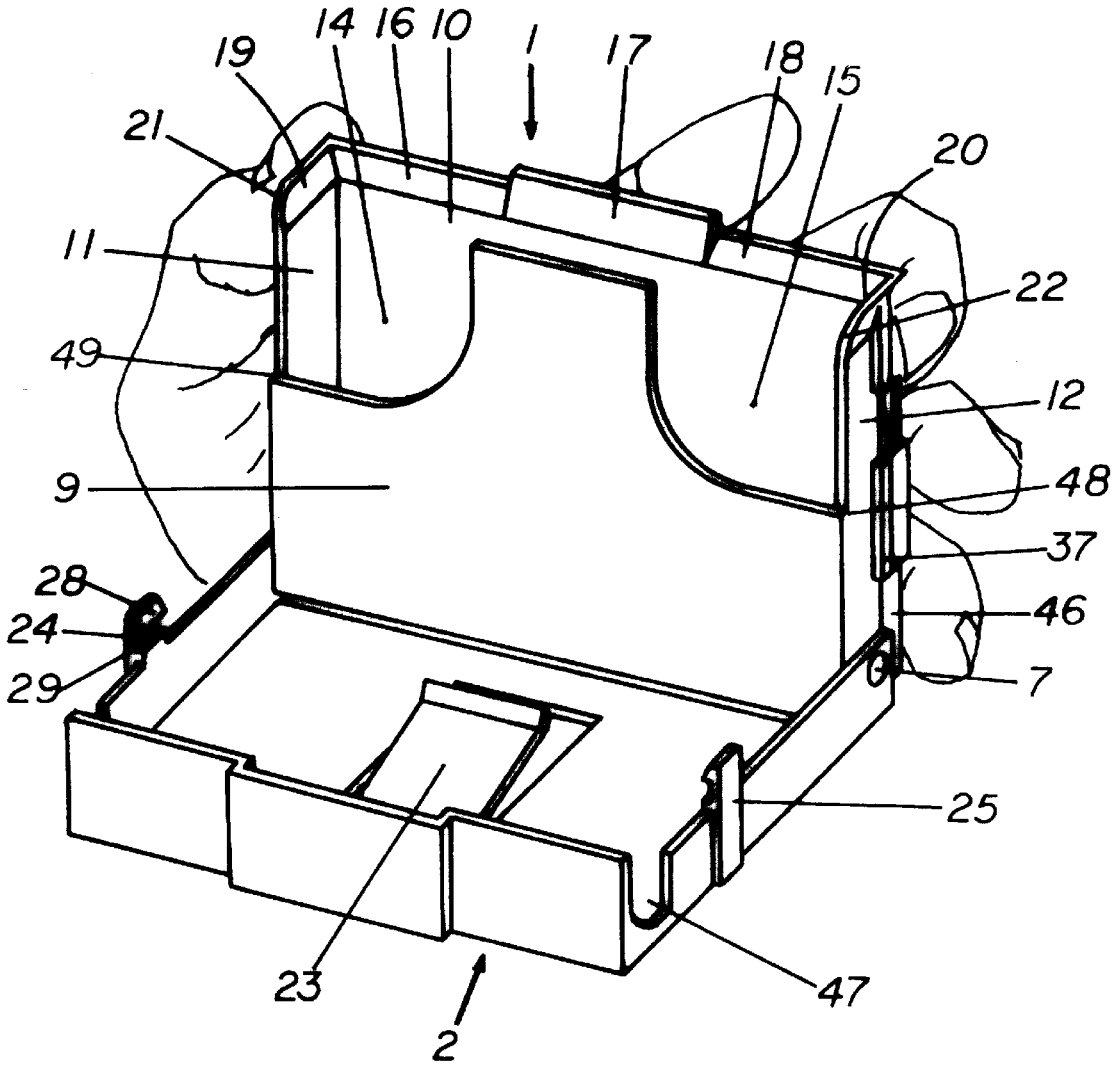
FIG. 1*a* is a perspective view of the pocket carrier of index cards in accordance with the present invention, illustrating the position of thumb and fingers when said carrier is opened.
Figure 3A:
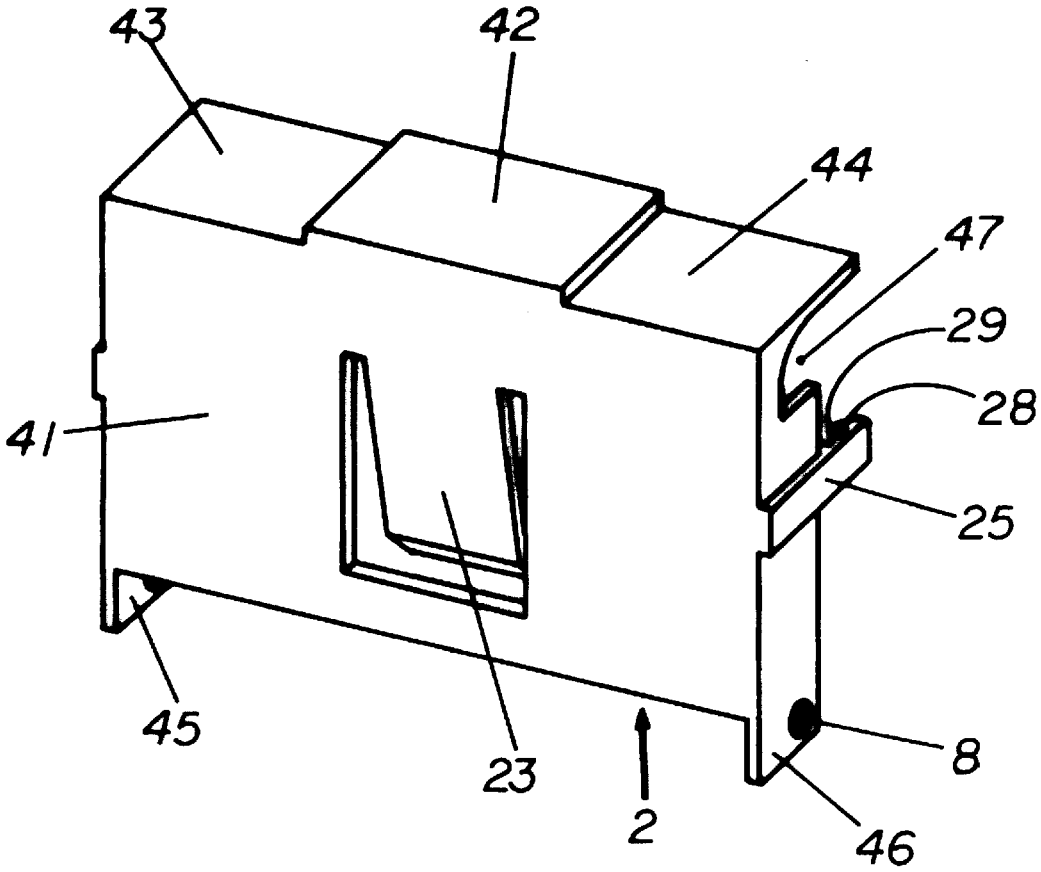
FIG. 3*a* is a perspective view of the hood of the pocket carrier of index cards in accordance with the present invention, illustrating the plate spring that is deflected inwardly when the carrier is not closed.
Figure 3B:
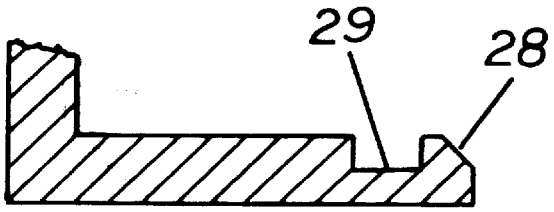
FIG. 3*b* is a cross-sectional view of the hook attached on the two lateral side of the hood, showing the tapered portion at the tip and the squared groove that accommodates the anchoring blade of the latch set when the hood is locked.
Figure 4:
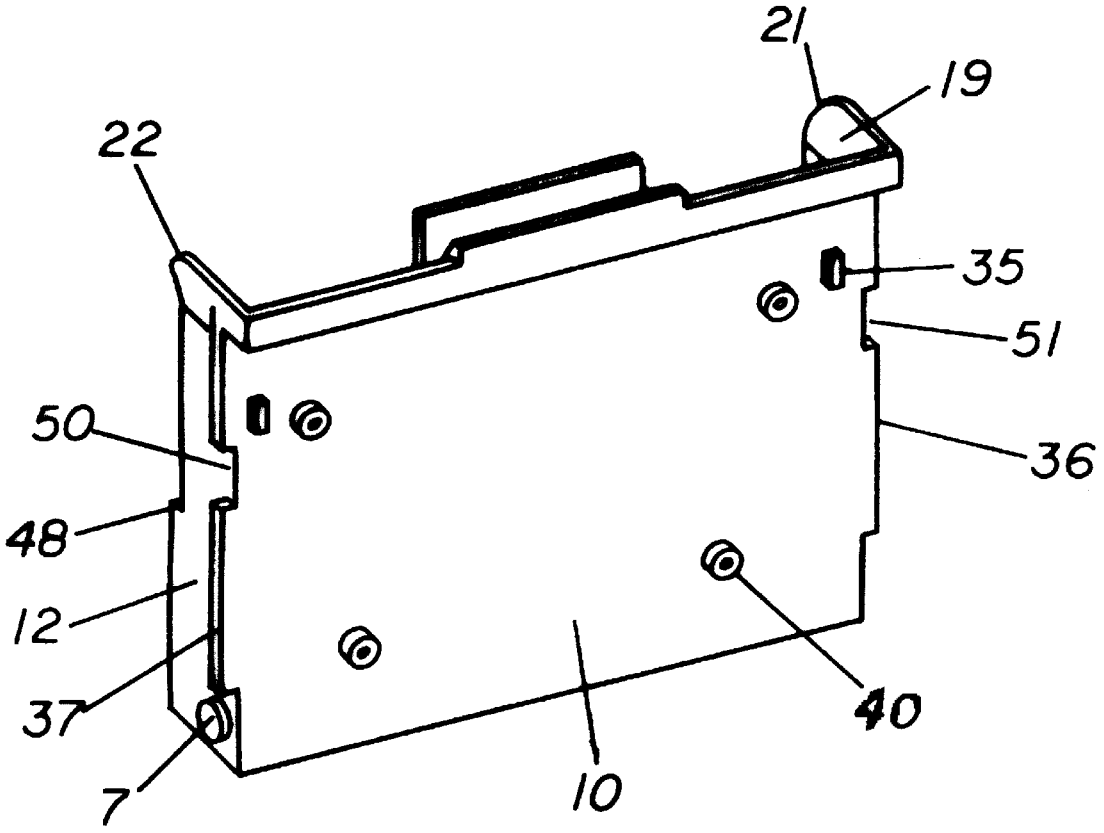
FIG. 4 is a rear perspective view of the main body of the pocket carrier of index cards in accordance with the present invention, showing the attached latch set when the rear cover plate of the latch set is removed.
Figure 5A:
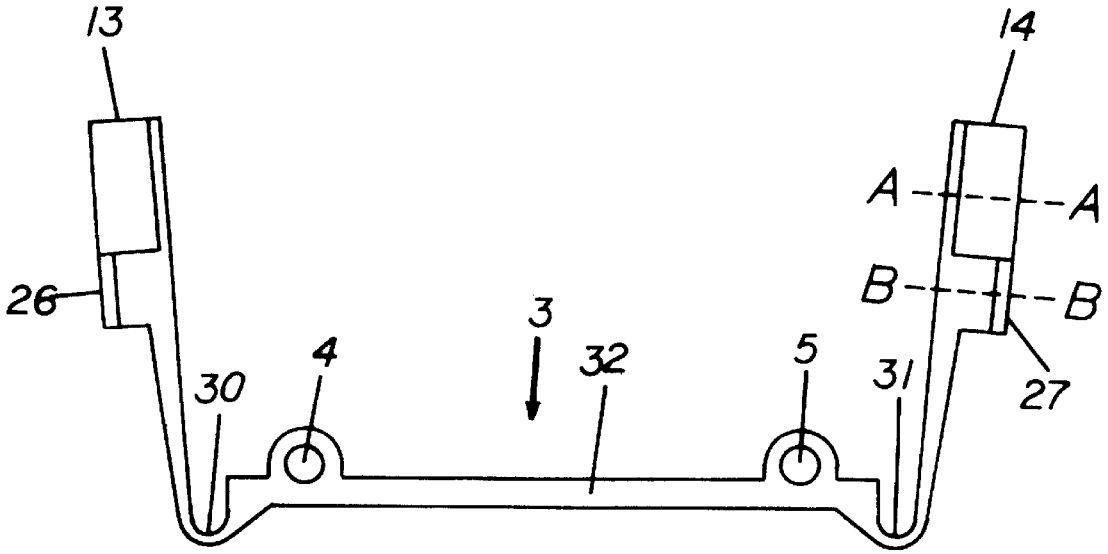
FIG. 5*a* is a plan view of the latch set, showing the anchoring blades to be in mesh with the squared groove of the hook of FIG. 3*b* and the tabs that are used for opening the pocket carrier in accordance with the present invention.
Figure 5B:
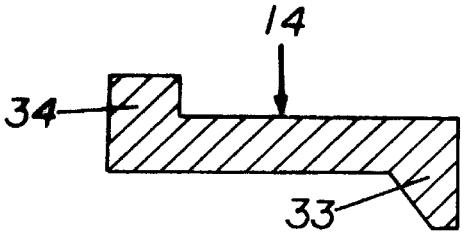
FIG. 5*b* is a cross-sectional view of the tab at A—A illustrated in FIG. 5*a;*
Figure 5C:
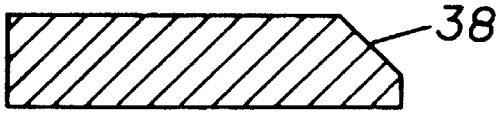
FIG. 5*c* is a cross-sectional view of the anchoring blade at B—B illustrated in FIG. 5*a*.
Figure 6:
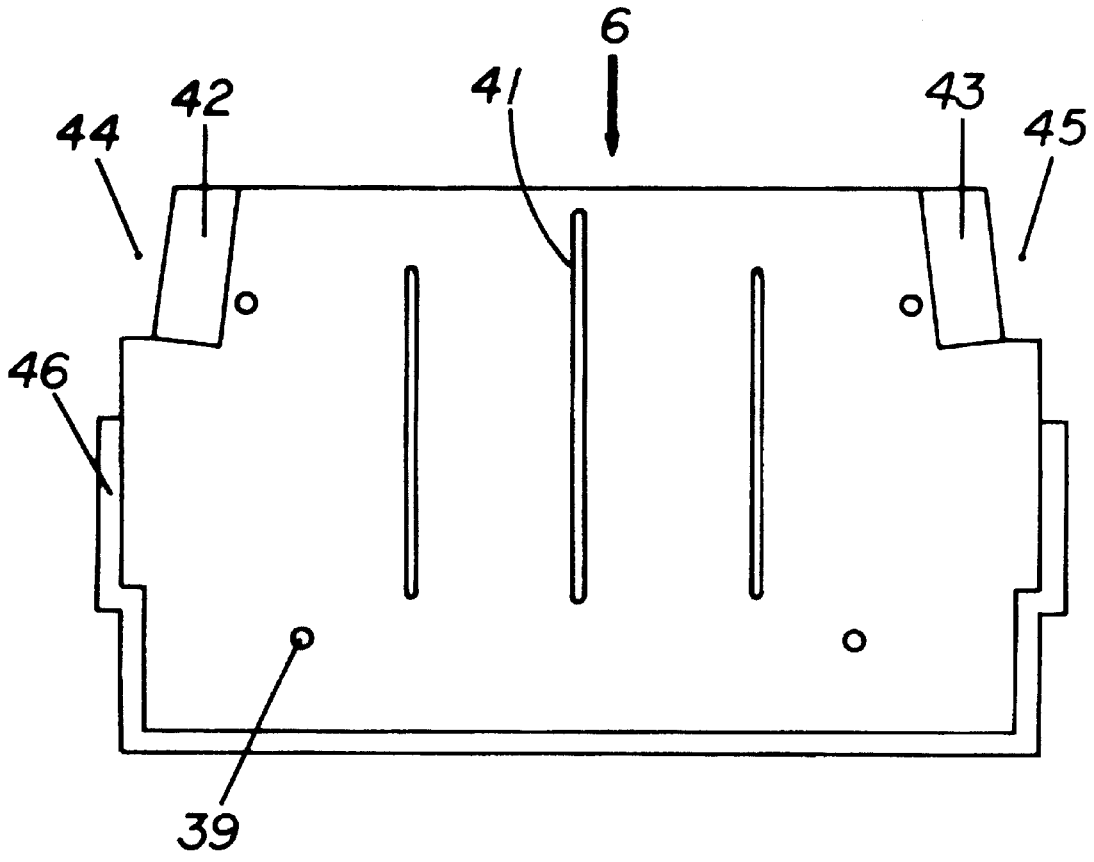
FIG. 6 is a perspective view of the rear cover plate for the latch set in accordance with the present invention, illustrating the screw holes which are used when the rear cover plate is fastened to the rear exterior side of the main body to cover the latch set.

A preferred embodiment of the present invention is shown in FIGS. 1*a*, 1*b*, 3*a*, and 4, which are the perspective views of the pocket carrier of index cards. The pocket carrier of index cards comprises a main body 1, a hood 2, as shown in FIG. 1*a*. The latch set 3, as shown in FIG. 5*a*, is attached on the rear face of the main body 1 by using the two holes 4 and 5. This latch set is protected by the cover plate 6, as shown in FIG. 6, which is securely fastened to the main body by a plurality of screws.

To solve the aforementioned problems of prior-art carriers and achieve the expedience and handiness without said shortcomings, a plurality of features are utilized in the present invention. The main body has front-side wall 9, rear-side wall 10, left lateral-side wall 11, right lateral-side wall 12, and the bottom 13. The educational flash cards are inserted through the top opening into the main body. The front-side wall 9 has generally the same height as the cards contained therein. The two concave sections 14 and 15 are introduced at the left and right top corners of the front-side wall of the main body so that the front one of the cards stacked therein can be easily pushed up and grasped by using the thumb and a finger of the other hand that is not holding the carrier. The left-handed users may use the left concave section 14 and the right-handed users may use the right concave section 15 to approach the card at the front side. After the front one of the stacked cards contained in the main body is retrieved and reviewed, the card is returned back into the main body between the rearmost card and the inner face of the rear-side wall of the main body, guided by the top portions 16, 17, 18, 19, and 20 of the rear-side and the two lateral-side walls which are tapered outwardly at an angle generally in the range of about 20 degrees to 70 degrees relative to the plane of the rear-side and lateral-side walls. A wedged space is created between the inner surface of the tapered top portion of the rear-side wall and the rearmost card, which is essential to returning the reviewed card back into the main body. This tapered top portion consists of three sections; the higher central section 17 which has a smaller taper angle, and the two adjacent sections 16 and 18 which are lower and have a larger taper angles than said central section. The tapered top portions 19 and 20 of the two lateral-side walls of the main body also make it easy to insert the card without damaging the corners of the card.

The front top corners 21 and 22 of said tapered top portions of lateral-side walls are smoothly rounded so as not to interrupt the sliding of the thumb as it pushes up the card at the front.

The width of each of said lateral-side walls 11 and 12 of the main body has been narrowed as much as the thickness of the front-side wall at the section 48 and 49, where the left and right top corner portions of the front-side wall are removed.

Figure 1B:
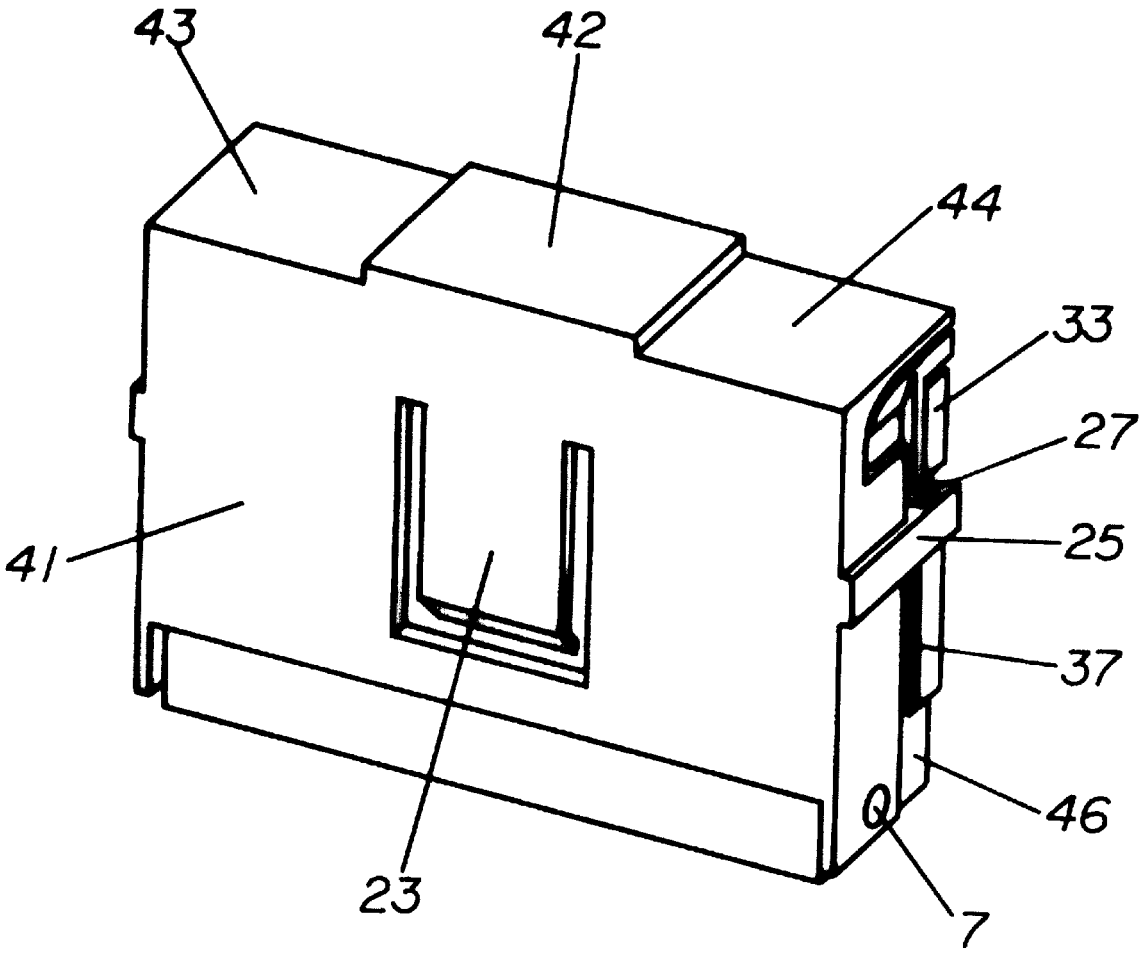
FIG. 1*b* is a perspective view of the pocket carrier of index cards in accordance with the present invention when said carrier is closed.
Figure 2A:
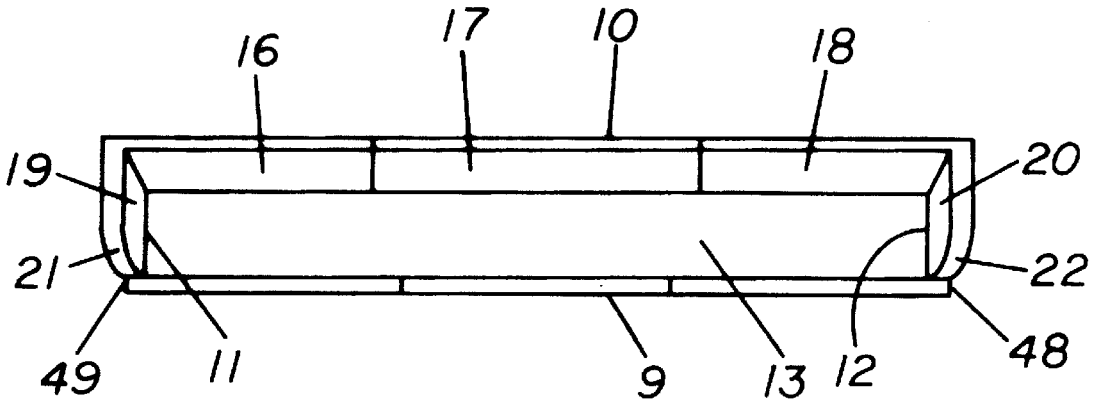
FIG. 2*a* is a top view of the main body of the pocket carrier of index cards in accordance with the present invention.
Figure 2B:
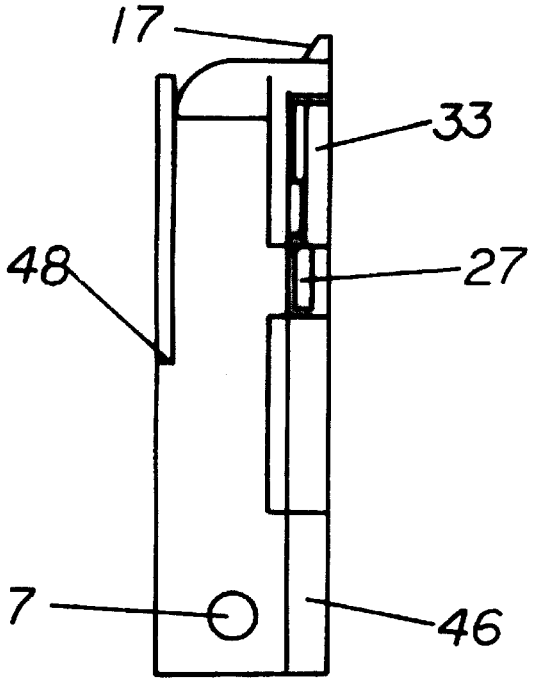
FIG. 2*b* is a side view of the main body of the pocket carrier of index cards in accordance with the present invention.

In the present invention, one of the objectives is opening or closing of the carrier in a single step motion by using only one hand, leaving the other hand free to work with the index cards contained therein. In order to achieve this objective, a hood 2 is designed to have a front-side wall 41, a top-side wall comprising a higher middle section 42 and two lower left and right sections 43 and 44 adjacent thereto, and two lateral-side walls 45 and 46. The front-side wall has a plate spring 23 that is deflected inwardly when the carrier is not closed, as shown in FIGS. 1*a* and 3*a*. Each of said two lateral-side walls has a hook 25, a concave section 47, and a hinge hole 8 that is hinged on the hinge pin 7 at each lateral-side wall of the main body. The concave section 47 is needed to accommodate the outwardly tapered top sections 19 and 20 of the lateral-side walls of the main body when the carrier is closed. The plate spring 23 is straightened in outward bending, pushed by front-side wall of the main body when the hood is closed, as illustrated in FIG. 1*b*. The hood is opened by the elastic force latent in the spring that pushes the main body 1. The two hooks 24 and 25 are locked on the anchoring blades 26 and 27 of latch set 3 of FIG. 5*a*, when the carrier is closed, as illustrated in FIG. 1*b*.

The rear-side wall of the main body is extended outwardly at the left and right peripheral edges to make hood stop flanges 36 and 37, part of which are removed from sections 50 and 51 to allow the hooks to reach the anchoring blades placed behind the rear-side wall of said main body.

The locking procedure is very short and simple as follows. When the main body and the hood are simply put together, the tapered section 28 at the tip of each hook pushes in the anchoring blade 26 or 27 of latch set 3. When the hook is pushed in further against the main body, the tapered section at the tip of each hook is switched by the squared-groove section 29 thereof, and the anchoring blade snaps back into groove 29 to lock the hook in the closed position. When the anchoring blades 26 and 27 retreat as the opening tabs 13 and 14, shown in FIG. 5*a*, are pulled in toward each other by the thumb and a finger, as illustrated in FIG. 1*a*, the hooks 25 of the hood are released from said anchoring blades, and the plate spring of the hood 23, which is in deformed state of bending when the carrier is closed, pushes the main body to flip-open the hood immediately. All this opening procedure is accomplished by using only one hand in a fraction of a second, leaving the other hand free to work with the index cards contained therein.

The spacious room behind the main body, inevitably created since the tapered sections at the top portions of the rear-side wall are thicker than the lower portion thereof, is utilized to accommodate the latch set 3 and the rear cover plate 6 thereof. The latch set consists of four components; opening tabs 13 and 14, said anchoring blades 26 and 27, springs 30 and 31, and a connector rod 32, as illustrated in FIG. 5*a*. Each of the opening tabs has raised holder 33 at the peripheral edge of the rear side and a stepped portion 34 on the other edge of the front side. The stepped portions 34 rest on the stoppers 35 at the rear surface of the main body to keep the opening tab from being deflected beyond the peripheral flanges 36 and 37 of the rear-side wall of the main body. Each of the anchoring blades 26 and 27, which are adjacent to the opening tabs, has a tapered section 38, as illustrated in the cross-sectional view, that is compatible with the tapered section 28 of the hook of the hood. The thin semicircular springs 30 and 31 deform in bending uniformly all over their span to secure the large deflection of the anchoring blades even with a small force applied to the opening tabs. The connector rod 32 has a plurality of holes 4 and 5 that are used to fit the latch set to the rear surface of the main body. The latch set 3 is protected by the rear cover plate 6 that is securely fastened with the screws to the main body of the carrier. The rear cover plate 6 has a plurality of screw holes 39 that correspond to the screw holes 40 at the rear face of the main body (FIG. 4). A plurality of stiffeners 41, which work as the reinforcement of the rear cover plate, also keep the rear cover plate spaced from the main body. The recessed sections 42 and 43 and the two concave sections 44 and 45 are introduced at an angle to accommodate the pivotal motion of the tabs of the latch set between the rear cover plate and the main body of the carrier. The peripheral guard 46 protects the latch set 3, covering the space between the rear cover plate and the main body at the lateral sides and bottom side of the carrier.

I claim:

1. A pocket carrier of index cards comprising a main body having a plurality of walls including a front-side wall, a rear-side wall, and two lateral-side walls; said front-side wall generally having the height of the index cards contained therein; said rear-side wall having the top inner portions outwardly tapered at an angle generally in the range of about 20 degrees to 70 degrees relative to the plane of the rear-side wall; outer face of said rear-side wall having a plurality of screw holes and a plurality of latch stop means; said two lateral-side walls having the top inner portions outwardly tapered at an angle generally in the range of about 20 degree to 70 degrees relative to the plane of lateral-side walls; said two lateral-side walls having a plurality of hood stop flanges; said two lateral-side walls having two hinge pins at the lower section thereof;

a hood consisting of a front-side wall, a top-side wall, two lateral-side walls; said front-side wall having a plate spring; each of said two lateral-side walls having a hook, a hinge hole, and a concave section;

a latch set consisting of opening tabs, anchoring blades, springs, and a connector rod; each of said opening tab having a raised holder along the peripheral edge of the outer surface and a linearly embossed portion at the opposite peripheral edge of the inner surface; each of said anchoring blades having a tapered edge; each of said springs having a generally semicircular shape; said connector rod having a plurality of holes;

a rear cover plate having two concave sections and recessed sections at the two top corners thereof and a plurality of holes; each of said concave sections having a shape and an angle to accommodate the pivotal motion of said tabs of the latch set when it is pulled in to open the hood of the carrier.

2. A pocket carrier of index cards as set forth in claim 1, wherein said tapered top portion of the rear-side wall consists of a central higher section at a smaller taper angle and two adjacent lower sections at a larger taper angle.

3. A pocket carrier of index cards as set forth in claim 1, wherein said tapered top portions of lateral-side walls are rounded smoothly around the front corners so as not to impede sliding of the thumb when it pushes up and grasp the index card contained therein.

4. A pocket carrier of index cards as set forth in claim 1, wherein the left top corner portion and the right top corner portion of said front-side wall are removed as much as needed for the thumb to approach the front one of the index cards contained therein.

5. A pocket carrier of index cards as set forth in claim 1, wherein the width of each of said lateral-side walls of the main body has been narrowed as much as the thickness of the front-side wall at the section where the left and right top corner portions are removed.

6. A pocket carrier of index cards as set forth in claim 1, wherein said top-side wall of the hood comprising a higher middle section and the two lower left and right sections adjacent thereto.

7. A pocket carrier of index cards as set forth in claim 1, wherein each of said hooks of the hood has a tapered tip and consecutively a square groove which is locked by said anchoring blade of the latch set when the hood and the main body are put together.

8. A pocket carrier of index cards as set forth in claim 1, wherein said concave section on each lateral-side wall of the hood is placed at the top portion to accommodate the outwardly tapered and extended top sections of the lateral-side walls of the main body when the carrier is closed.

9. A pocket carrier of index cards as set forth in claim 1, wherein the space created under said tapered top portions of the rear side wall and behind the rear-side wall of the main body is utilized to accommodate said latch set and rear cover plate.

10. A pocket carrier of index cards as set forth in claim 1, wherein part of said hood stop flange is removed to allow the hooks to reach the anchoring blades placed behind the rear-side wall of said main body.

11. A pocket carrier of index cards as set forth in claim 1, wherein said raised holder on each of the opening tabs is aligned to the peripheral edges of the rear-side wall of the main body to enable the user to pull the tabs toward each other easily by using the thumb and a finger holding the carrier.

* * * * *